US007198697B2

(12) United States Patent
Bartelmuss et al.

(10) Patent No.: US 7,198,697 B2
(45) Date of Patent: Apr. 3, 2007

(54) SUPPORTING AND WIPING DEVICE FOR MACHINE WIRE SYSTEMS

(76) Inventors: Klaus Bartelmuss, NR. 63, A-8833, Teufenbach (AT); Heinz Bartelmuss, NR. 63, A-8833, Teufenbach (AT)

( * ) Notice: Subject to any disclaimer, the term of this patent is extended or adjusted under 35 U.S.C. 154(b) by 442 days.

(21) Appl. No.: 10/756,085

(22) Filed: Jan. 13, 2004

(65) Prior Publication Data

US 2004/0238142 A1 Dec. 2, 2004

(30) Foreign Application Priority Data

May 28, 2003 (AT) ..... A 827/2003

(51) Int. Cl.
*D21G 9/00* (2006.01)
*D21F 1/20* (2006.01)

(52) U.S. Cl. ..... 162/352; 162/351; 162/354; 162/374

(58) Field of Classification Search ..... 162/199, 162/274, 209, 211, 351, 325, 363, 374, 352, 162/353, 354
See application file for complete search history.

(56) References Cited

U.S. PATENT DOCUMENTS 3,194,729 A * 7/1965 Robinson ..... 162/374
4,957,598 A * 9/1990 Corbellini ..... 162/363
5,076,894 A * 12/1991 Simmons et al. ..... 162/352
5,630,910 A * 5/1997 McPherson ..... 162/352

* cited by examiner

*Primary Examiner*—Eric Hug
(74) *Attorney, Agent, or Firm*—Laurence A. Greenberg; Werner H. Stemer; Ralph E. Locher

(57) ABSTRACT

A supporting and wiping device is assigned to the machine wire in a paper-making system. The supporting and wiping device has supporting and wiping strips firmly held on a carrying frame or the like and extending transversely with respect to a direction of movement of the machine wire. The carrying frame has two carrying beams aligned parallel to the supporting and wiping strips and two-part transverse webs arranged between said beams and capable of being fixed to the latter, on the one hand the transverse webs and on the other hand the supporting and wiping strips being formed with mutually associated recesses and projections, by way of which the transverse webs and the supporting and wiping strips can be connected to one another and clamped by displacing the two parts of the transverse webs with respect to each other.

10 Claims, 5 Drawing Sheets

SUPPORTING AND WIPING DEVICE FOR MACHINE WIRE SYSTEMS

BACKGROUND OF THE INVENTION

Field of the Invention

The present invention relates to a supporting and wiping device which is assigned to the machine wire in a system for paper production and which has supporting and wiping strips disposed firmly on a carrying frame or the like and aligned transversely with respect to the direction of movement of the machine wire.

Prior art such supporting and wiping devices are constructed with supporting and wiping strips fixed to a carrying frame or the like. The supporting and wiping strips are fastened to the carrying frame either detachably, for example by means of screw fixing, or not immediately detachably, for example by means of adhesive bonding, i.e., gluing.

Various demands are placed on the support of such wiping strips. There is, firstly, the requirement to fasten them rigidly, and unintentional loosening of the fastening must be ruled out. On the other hand, however, there is also the requirement to fasten the supporting and wiping strips in such a way that, after they have been damaged or after they have worn, they can be replaced by new supporting and wiping strips. In order to be able to arrange new strips, it is accordingly expedient to fasten them detachably. However, a rigid but additionally detachable fastening of the supporting and wiping strips, corresponding to the operational requirements, necessitates a great deal of effort both when fastening the supporting and wiping strips and also when loosening them from their fastening.

SUMMARY OF THE INVENTION

It is accordingly an object of the invention to provide a support and wiping device for screen assemblies which overcomes the above-mentioned disadvantages of the heretofore-known devices and methods of this general type and in which the supporting and wiping strips, firstly, are fastened rigidly in accordance with the operational requirements and in which, irrespective of the latter, the fastening of the supporting and wiping strips can be produced and loosened in a simple way.

With the foregoing and other objects in view there is provided, in accordance with the invention, a supporting and wiping device for a machine wire in a paper-making system, comprising:

a carrier, such as a carrier frame or the like;

a plurality of supporting and wiping strips firmly supported by the carrier and aligned transversely with respect to a direction of movement of the machine wire;

the carrier having two carrying beams aligned substantially parallel to the supporting and wiping strips and two-part transverse webs between the beams, the two-part transverse webs having at least two parts and being configured to be fixed to the beams;

the transverse webs and the supporting and wiping strips being formed with mutually associated voids and projections, for facilitating a connection between the transverse webs and the supporting and wiping strips, and wherein the at least two parts of the transverse webs are displaceably disposed for clamping the supporting and wiping strips.

In other words, the objects of the invention are achieved by the carrying frame or the like having two carrying beams aligned parallel to the supporting and wiping strips and two-part transverse webs arranged between said beams and capable of being fixed to the latter, on the one hand the transverse webs and on the other hand the supporting and wiping strips being formed with mutually associated recesses and projections, by means of which the transverse webs and the supporting and wiping strips can be connected to one another and clamped by displacing the two parts of the transverse webs with respect to each other.

Supporting and wiping strips are preferably formed with carrying strips, by means of which they can be coupled to the transverse webs via recesses provided in the two parts of the transverse webs. Alternatively, the supporting and wiping strips can be formed with grooves, by means of which they can be coupled to the transverse webs via projections provided on the two parts of the transverse webs. Furthermore, supporting and wiping strips can be formed with recesses, by means of which they can be coupled to the transverse webs via projections provided on the two parts of the transverse webs.

In this case, the recesses of the parts of the transverse webs and the grooves or recesses of the supporting and wiping strips can be undercut, and the respectively associated carrying strips of the supporting and wiping strips and the projections of the two parts of the transverse webs can be designed so as to widen toward their free ends.

In particular, moreover, the two parts of the transverse webs rest on each other and their recesses and projections are offset with respect to one another in relation to their end faces, as a result of which the mutually coupled supporting and wiping strips and transverse webs are clamped as a result of displacing the two parts of the transverse webs with respect to each other as the transverse webs are fastened to the two carrying beams.

According to a preferred embodiment, one of the two parts of the transverse webs is formed as a plate which, along one of the side edges, is formed with recesses and projections, and the other of the two parts of the transverse webs is formed as a double-walled plate which surrounds the first plate on its two outer sides and which is likewise formed, along one of its side edges, with recesses and projections assigned to the recesses and projections of the first part. In particular, in this case the second parts of the transverse webs are of U-shaped cross section, being formed with the recesses and with the projections in the region of their webs.

Other features which are considered as characteristic for the invention are set forth in the appended claims.

Although the invention is illustrated and described herein as embodied in a supporting and wiping device for machine wire systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
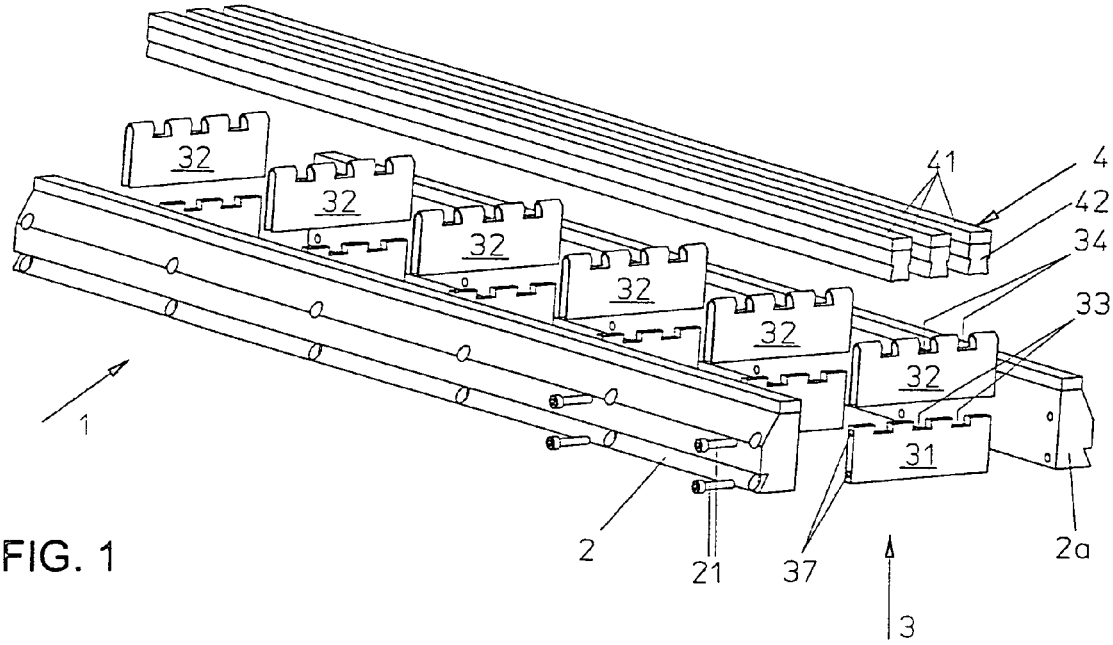
FIG. 1 is an exploded, axonometric view of a supporting and wiping device according to the invention.
Figure 2:
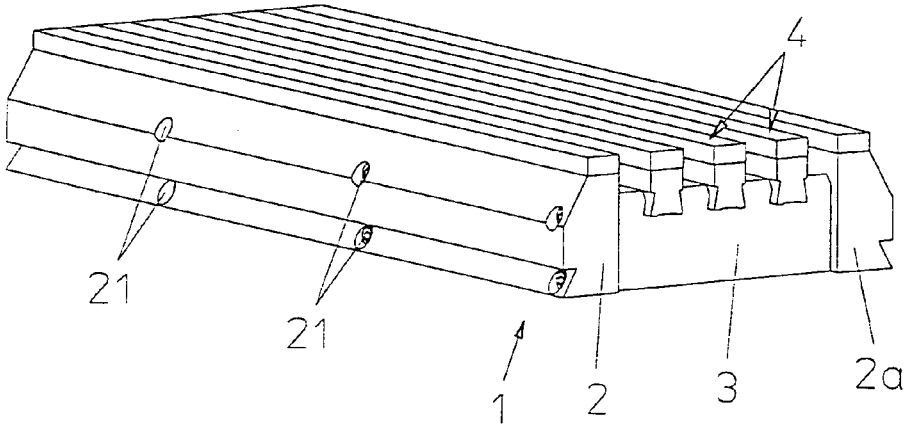
FIG. 2 is an axonometric view of the supporting and wiping device according to FIG. 1.

Referring now to the figures of the drawing in detail and first, particularly, to FIGS. 1 and 2 thereof, there is shown a supporting and wiping device according to the invention which is used for a paper production system. The paper-making machine includes a machine wire, the machine wire being moved along the surfaces of supporting and wiping strips. The supporting and wiping device has a frame-like carrier 1 for supporting and wiping strips 4. The supporting and wiping strips 4 are provided with wearing strips 41 on their upper side. On their lower side, they are formed as dovetail-like carrying strips 42. The carrier 1 comprises two carrying beams 2 and 2*a* aligned parallel to the wiping strips 4 which, by means of webs 3 aligned transversely with respect thereto, are connected to each other by being screwed to the webs 3 by means of screws 21.

Each of the webs 3 comprises two parts 31 and 32 which, at their upper edges, are formed with voids 33, 34—in this case, undercut recesses 33 and 34. It is thereby possible for the carrying strips 42 of the supporting and wiping strips 4 to be inserted into these recesses 33 and 34, which are associated with one another. The web parts 31 are further formed with holes 37 assigned to the screws 21.

Figure 2A:
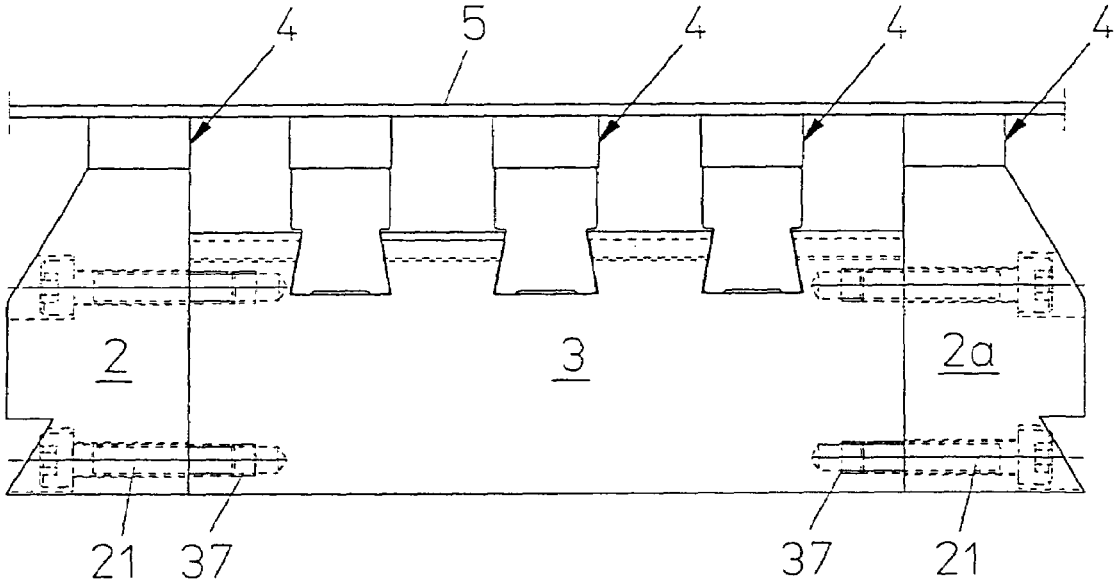
FIG. 2A is an elevational side view of the device of FIG. 2.

Also illustrated in FIG. 2A is a machine wire 5, which is guided over the supporting and wiping strips 4.

Figure 3:
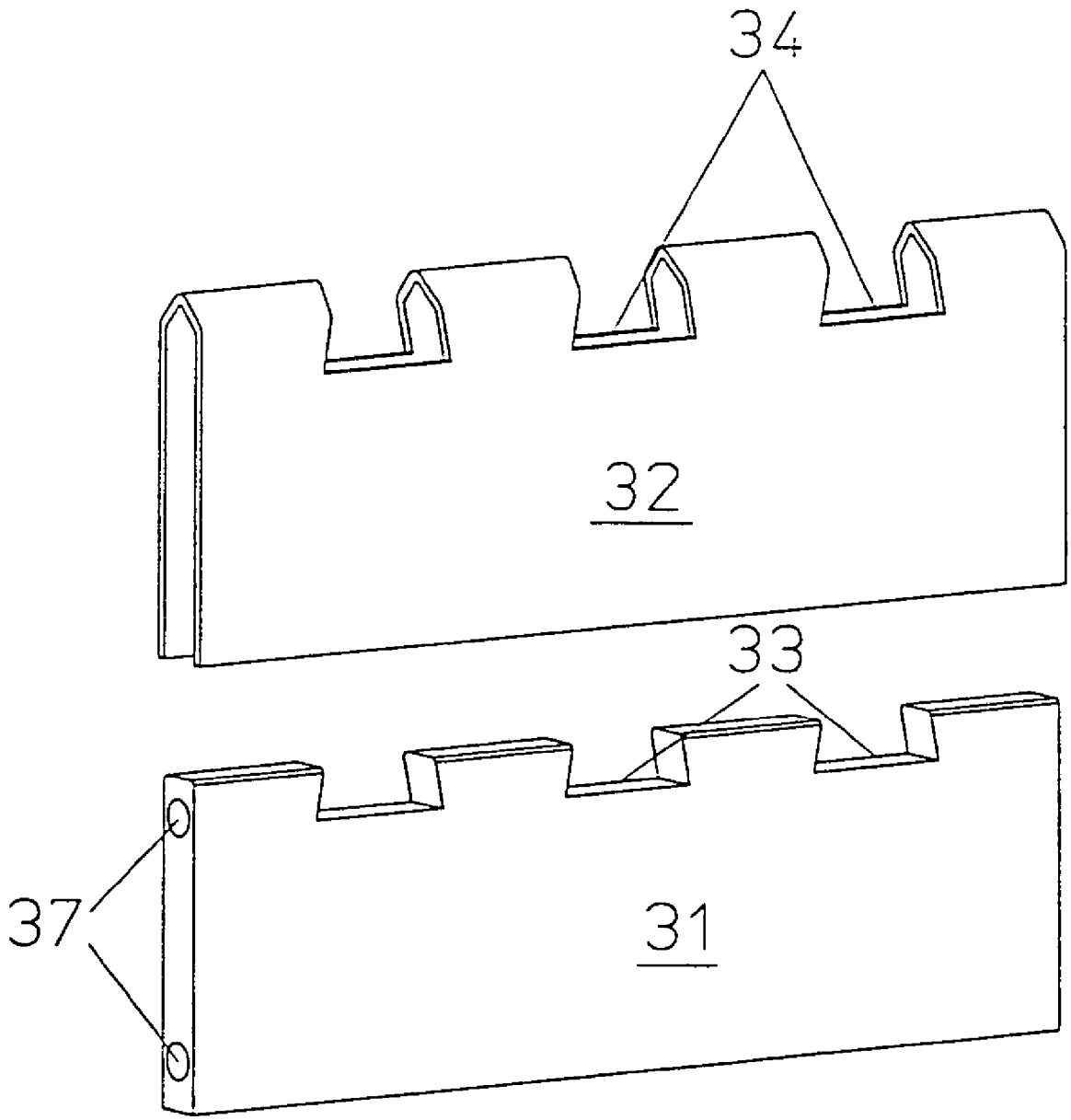
FIG. 3 is an exploded, axonometric illustration of a constituent part according to FIG. 2, shown on an enlarged scale as compared with FIG. 1.

In FIG. 3, the two web parts 31 and 32 are illustrated on a scale that is enlarged with respect to FIG. 1.

Figure 4:
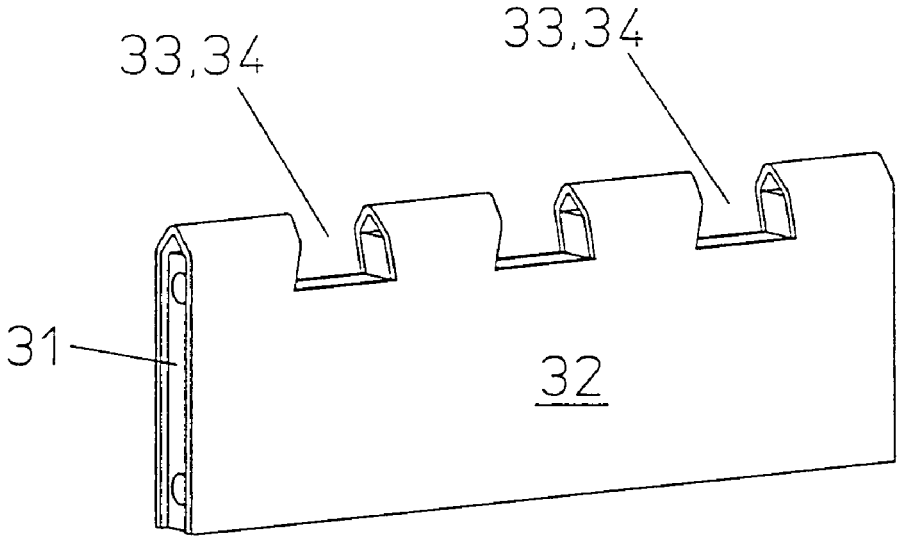
FIG. 4 is an axonometric view of the constituent part according to FIG. 3.
Figure 4A:
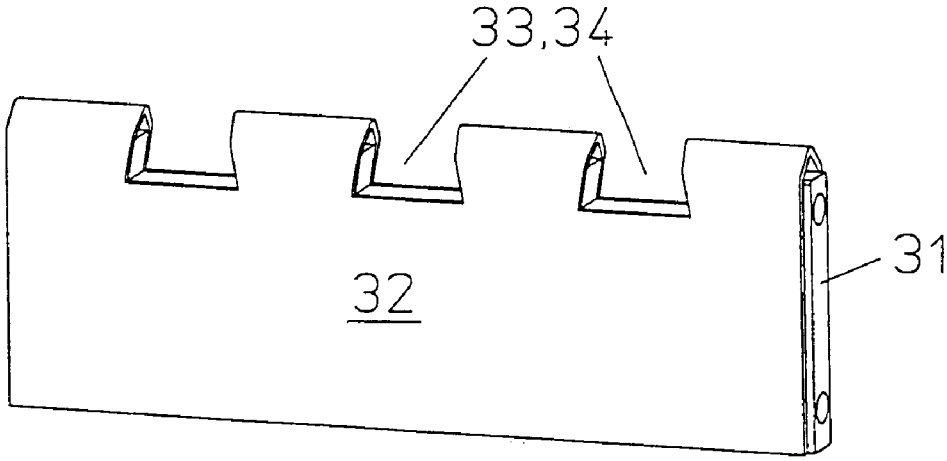
FIG. 4A is a further axonometric view of the constituent part according to FIG. 3.

As can further be seen from FIGS. 4 and 4A, the recesses 33 and 34 provided in the web parts 31 and 32 are offset slightly with respect to the end faces of the web parts 31 and 32 inasmuch as, when the recesses 33 and 34 are aligned with one another, on one of the two sides the web part 32 projects beyond the web part 31, and, on the other side, the web part 31 projects beyond the web part 32. This mutual position of the two web parts 31 and 32 occurs as soon as the supporting and wiping strips 4 have been inserted into the recesses 33 and 34. The recesses 33 and 34 are dimensioned such that the supporting and wiping strips 4 can be displaced in the latter with play and thus without significant resistance.

As soon as the supporting and wiping strips 4 are to be fixed rigidly, the screws 21 are screwed into the holes 37. In this way, the two carrying beams 2 and 2*a* come into contact with the mutually offset end faces of the two web parts 31 and 32, as a result of which the web parts 31 and 32 are displaced toward each other. In this way, the side edges in the two web parts 31 and 32 of the recesses 33 and 34 are displaced toward each another, as a result of which the supporting and wiping strips 4 located in the latter are clamped. For this clamping, it is sufficient if the side edges of the recesses 33 and 34 located in the web parts 31 and 32 are offset slightly with respect to one another. The offset in this regard is illustrated exaggeratedly in FIGS. 4 and 4*a* in order in this way to illustrate this mode of action.

Figure 5:
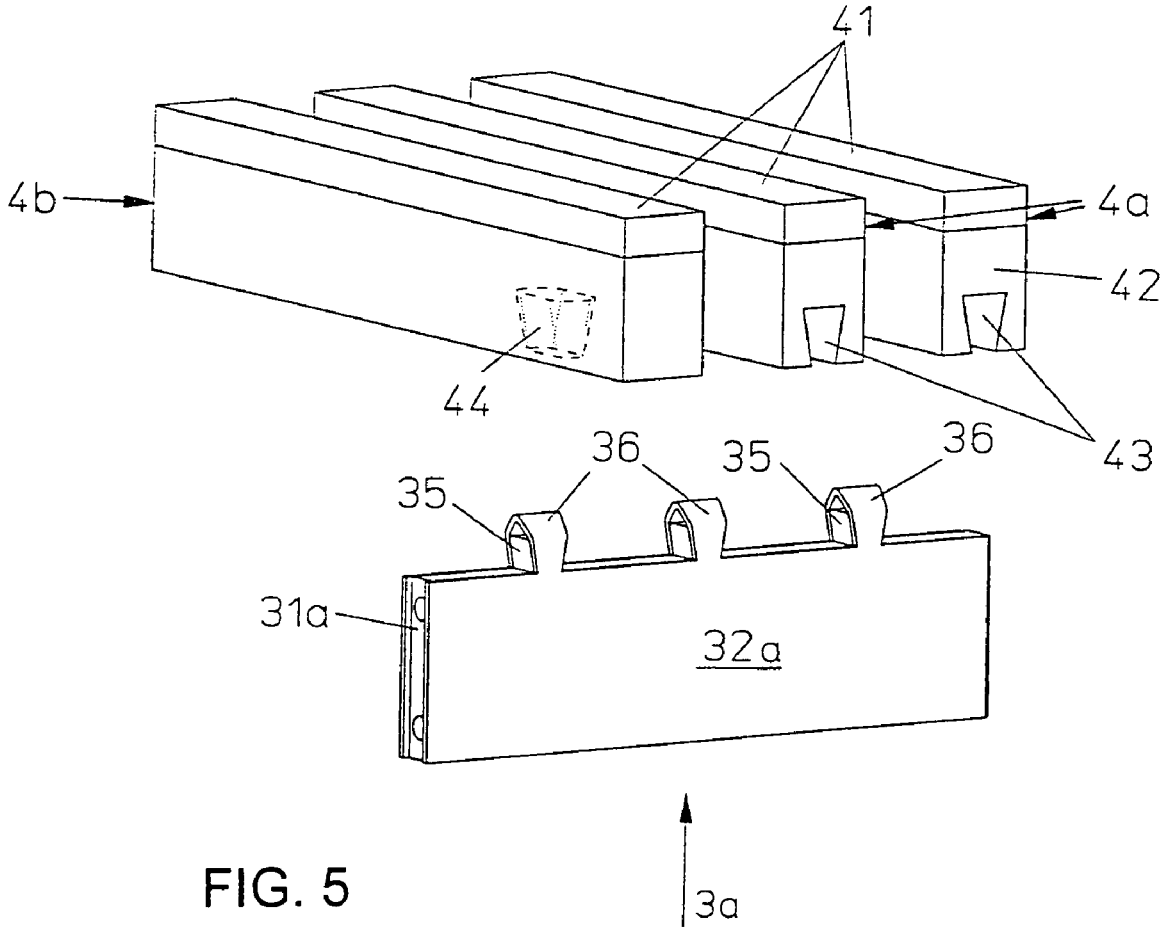
FIG. 5 is an axonometric illustration of an alternative embodiment of constituent parts of a supporting and wiping device according to the invention.

As can be seen from FIG. 5, the supporting and wiping strips 4*a* are formed with elongate voids, i.e., grooves 43, and the web parts 31*a* and 32*a* are formed on their upper edges with mutually corresponding projections 35 and 36, which are assigned to the grooves 43. In this case, the supporting and wiping strips 4*a* can be displaced with play over the projections 35 and 36 by means of the grooves 43, as a result of which the supporting and wiping strips 4*a* can be coupled to the webs 3*a*. In the process, again the end faces of the web parts 31*a* and 32*a* are offset slightly with respect to one another.

As an alternative to this, the supporting and wiping strips 4*b* are formed with recesses 44 which are assigned to the projections 35 and 36 and by means of which the supporting and wiping strips 4*b* can be placed on the webs 3*a* and coupled to the latter in this way. The rigid fastening of the supporting and wiping strips 4*a* and 4*b* is likewise carried out by the web parts 31*a* and 32*a* being displaced toward one another as a result of connecting the longitudinal beams 2 and 2*a* to the two web parts 31*a* and 32*a*, which means that their projections 35 and 36 are clamped within the grooves 43 or the recesses 44.

The invention thus described provides a supporting and wiping device in which the supporting and wiping strips are firstly fastened rigidly to their carrier, but in which, irrespective of this, the fastening of the supporting and wiping strips can be effected and released by rotating only a few screws. This considerably simplifies the replacement of damaged supporting or wiping strips.

We claim:

1. A supporting and wiping device for a machine wire in a paper-making system, comprising:

a carrier;

a plurality of supporting and wiping strips firmly supported by said carrier and aligned transversely with respect to a direction of movement of the machine wire;

said carrier having two carrying beams aligned substantially parallel to said supporting and wiping strips and a plurality of transverse webs between said beams, said transverse webs having at least two parts and being configured to be fixed to said beams;

said transverse webs and said supporting and wiping strips being formed with mutually associated voids and projections, for facilitating a connection between said transverse webs and said supporting and wiping strips, and wherein said at least two parts of said transverse webs are displaceably disposed relative to one another, and a relative displacement of said at least two parts causes said supporting and wiping strips to be clamped and secured to said carrier.

2. The device according to claim 1, wherein said carrier is a carrier frame.

3. The device according to claim 1, wherein said supporting and wiping strips include carrying strips configured for coupled to said transverse webs in recesses formed in said two parts of the transverse webs.

4. The device according to claim 1, wherein said supporting and wiping strips are formed with grooves, and each of said transverse webs includes two parts formed with projections for engaging into said grooves, and for coupling said wiping strips to said transverse webs.

5. The device according to claim 4, wherein said supporting and wiping strips have recesses formed therein, and said two parts of said transverse webs are formed with projections for engaging into said recesses, and for coupling said wiping strips to said transverse webs.

6. The device according to claim 1, wherein said voids of said parts of said transverse webs are undercut, and said supporting and wiping strips are formed with carrying strips widening toward free ends thereof.

7. The device according to claim 4, wherein said voids of said parts of said transverse webs and said grooves or recesses of said supporting and wiping strips are undercut, and respectively associated said carrying strips of said supporting and wiping strips and said projections of said two parts of said transverse webs are formed to widen toward free ends thereof.

8. The device according to claim 1, wherein said two parts of said transverse webs rest on one another and are formed with mutually offset recesses and projections relative to end faces thereof, whereby mutually coupled said supporting and wiping strips and said transverse webs are clamped as a result of displacing said two parts relative to one another as said transverse webs are fastened to said carrying beams.

9. The device according to claim 1, wherein one of said two parts of said transverse webs is formed as a first plate having a side edge formed with recesses and projections, and another one of said two parts of said transverse webs is formed as a double-walled plate surrounding said first plate on two sides, and wherein said double-walled plate has a side edge formed with recesses and projections assigned to said recesses and projections of said first plate.

10. The device according to claim 9, wherein said other one of said two parts of said transverse webs has a U-shaped cross section, and a bottom web of said U-shaped cross section is formed with said recesses and with said projections.

* * * * *